United States Patent [19]

Brandstäter et al.

[11] Patent Number: 4,553,126

[45] Date of Patent: Nov. 12, 1985

[54] RESISTANCE HEATING ELEMENT

[75] Inventors: Manfred Brandstäter; Alfred Könnemann, both of Wuppertal, Fed. Rep. of Germany

[73] Assignee: Grote & Hartmann GmbH & Co. KG, Fed. Rep. of Germany

[21] Appl. No.: 633,413

[22] Filed: Jul. 23, 1984

[30] Foreign Application Priority Data

Aug. 3, 1983 [DE] Fed. Rep. of Germany ..... 3328078

[51] Int. Cl.[4] ..... H01C 10/14

[52] U.S. Cl. ..... 338/319; 219/532; 338/280; 338/287; 338/290; 338/318

[58] Field of Search ..... 338/280, 287, 288, 290, 338/315, 316, 317, 318, 319, 320, 330; 219/532, 552

[56] References Cited

U.S. PATENT DOCUMENTS

| | | | |
|---|---|---|---|
| 2,162,030 | 6/1939 | Piazzoli, Jr. | 338/318 X |
| 2,736,786 | 2/1956 | Du Bois | 338/288 |
| 2,812,410 | 11/1957 | Du Bois | 338/280 |
| 2,858,402 | 10/1958 | Griffes et al. | 338/290 X |
| 3,408,735 | 11/1968 | Eisler | 338/280 X |
| 3,673,387 | 6/1972 | Dryemand et al. | 219/532 |
| 3,858,149 | 12/1974 | Kirilloff | 338/295 |
| 4,051,452 | 9/1977 | Luy | 338/319 X |
| 4,100,526 | 7/1978 | Kirilloff et al. | 338/279 |
| 4,146,868 | 3/1979 | Kirilloff et al. | 338/295 |
| 4,316,172 | 2/1982 | Luy | 338/318 X |

*Primary Examiner*—Volodymyr Y. Mayewsky
*Attorney, Agent, or Firm*—Goodman & Teitelbaum

[57] ABSTRACT

Resistance heating element, with a heat conductor led in meander pattern, which is fastened in the zone of the meander arches in bearing elements, characterized in that between the bearing elements there is arranged a heating conductor of at least one one-piece sheet metal stamped part strip (4) with bearing pins (25) and slide pins (27).

29 Claims, 5 Drawing Figures

RESISTANCE HEATING ELEMENT

Figure 1:
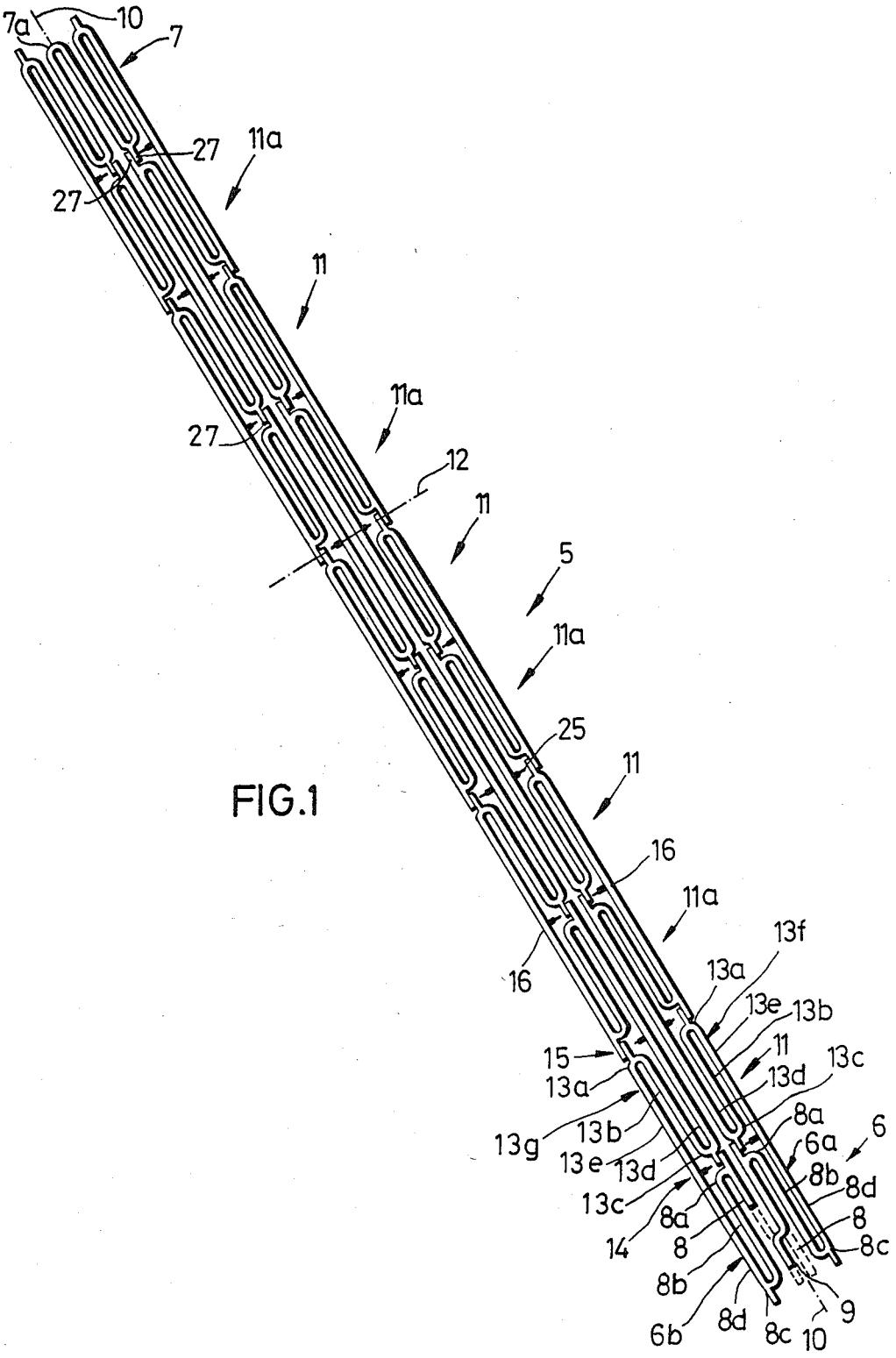

The invention relates to a resistance heating element for e.g. a suction air line between carburetor and motor of an internal combustion motor which is washed with a fluid.

The well-known resistance heating elements consist of a heating coil of a resistance metal wire which presents a round cross section. Besides, there has recently been proposed a resistance heating element which has in an upper and a lower plane in each case several adjacently arranged narrow fastening bars, there being conducted between the planes a resistance metal wire bent in meander pattern in such a way that in the longitudinal extent of the fastening bars the wire runs in a meander pattern, and, namely, from the upper to the lower plane, the wire being guided over at the end of a bar to the adjacent bar, and running from there in meander pattern to the other end of the adjacent bar and is again conducted to the next adjacent bar. There is yielded, therefore, not only a wire guidance in meander pattern between the planes, but also a meander-form lead-over from one fastening bar to adjacent fastening bars. The fastening of the resistance wire to the fastening bars is assured with special means. These consist of a loop which grips around the wire in the straght running zone in the vicinity of a meander curve; to the loop there is fastened a pin which is solidly borne in a fastening bar. In order to be able to catch up length changes arising on temperature fluctuation in such a way that they cause no destruction of the resistance heating element, in the proposed resistance heating element it is provided that each next-but-one loop encirles the resistance wire loosely in such a way that the wire can slide in the loop.

What is disadvantageous in this known resistance heating element is that for the catching up of the length changes a considerable expenditure has to be effected. There, the known fastening type, however, is not such that the fluid flows or jarrings remain without influence on the wire arrangement. On the wire turns there can be forced movements or vibrations that can lead to destruction.

The problem of the invention is to create a resistance heating element that is simply producible, offers the fluid a very large washable surface per volume unit and which can be very simply fastened in bearing elements, in which heatcaused length changes can be caught up without the bearings being disadvantageously affected.

This problem is solved by the features of the present invention and the advantageous--; forms of execution of the invention. With the aid of the drawing the invention is explained in detail by way of example.

Figure 2:
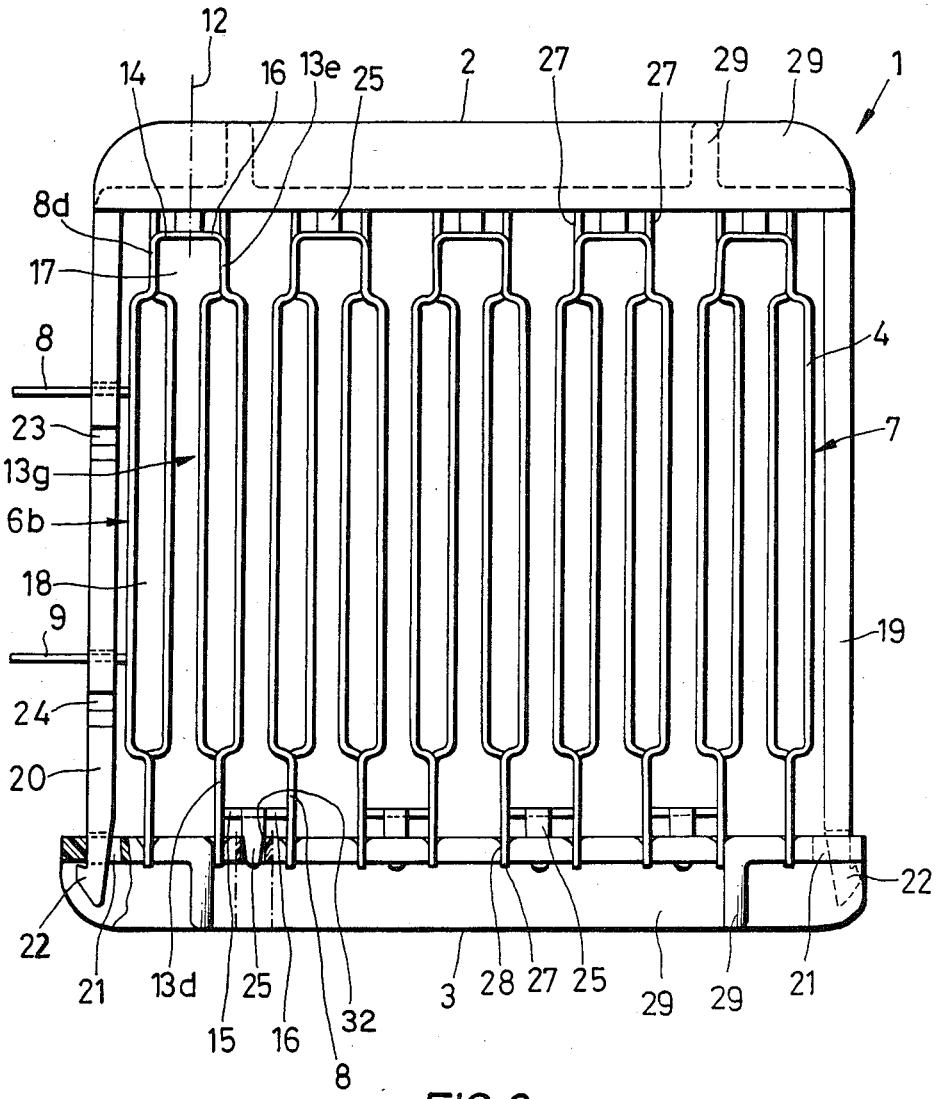
Figure 3:
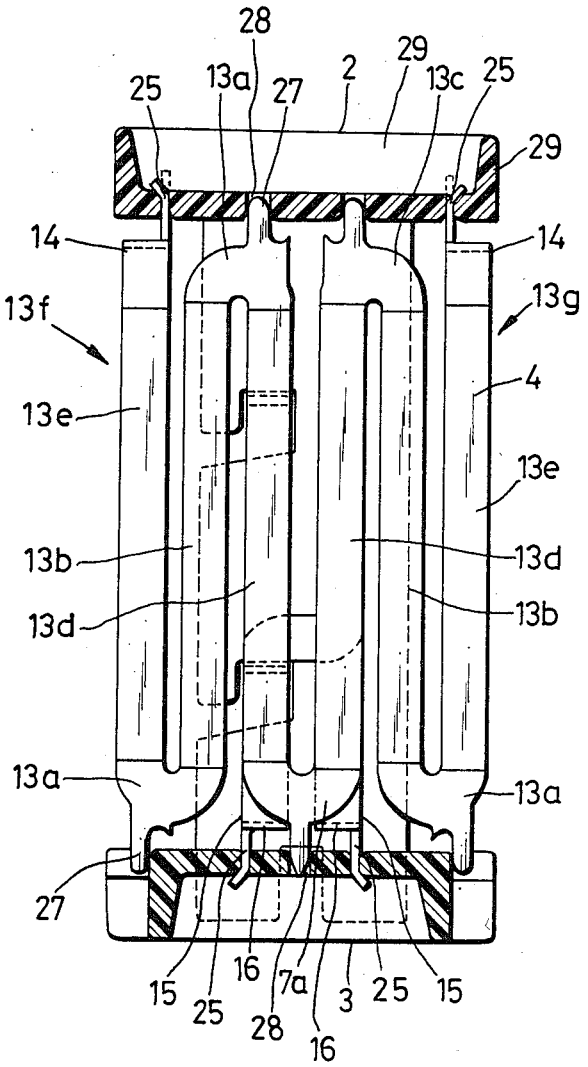
Figure 4:
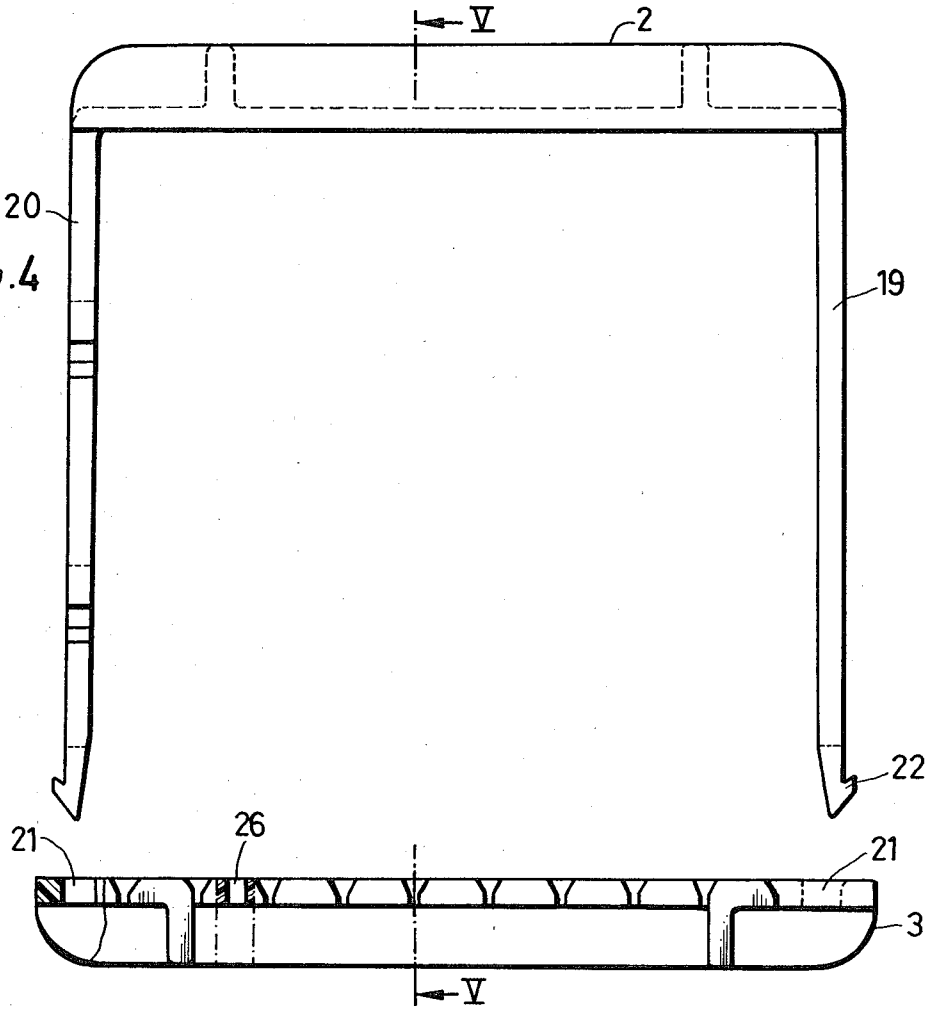
Figure 5:
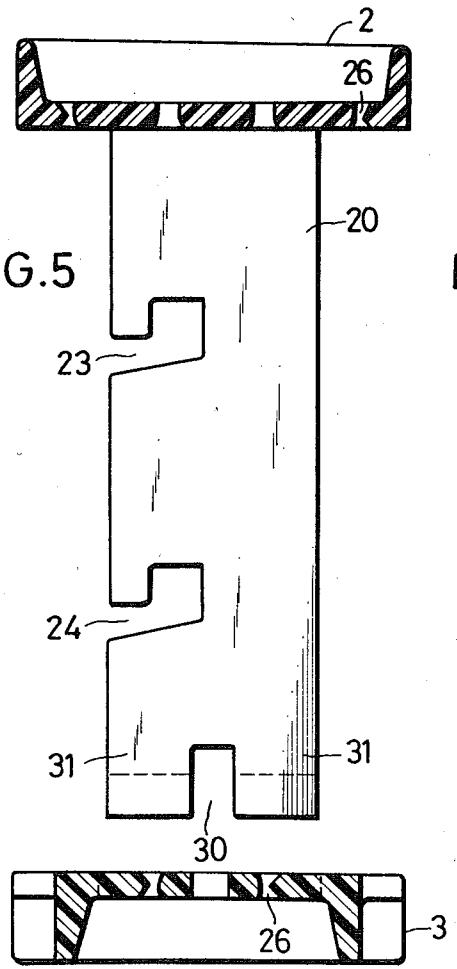

FIG. 1 shows the plate of the resistance element;

FIG. 2 a shows a partly sectional side view of the resistance heating element;

FIG. 3 a shows a sectional front view of the resistance heating element;

FIG. 4 a shows a partly sectional side view of the bearing plates;

FIG. 5 shows a section along the line V—V in FIG. 4 as viewed in arrow direction.

The object of the invention is preferably to provide a resistance element in miniature construction. For example, the element depicted in FIGS. 2 and 3 presents a width of 20 mm, a height of 40 mm and a length of 50 mm. With such small dimensions it is generally difficult to bear the resistance metal elements securely against jarring and to provided a great length or as many as possible turns, so that a relatively large surface of the metal element is available. The great length again involves length changes on temperature fluctuation that must be caught up without the fixed bearing of the metal element suffering in the process.

The resistance heating element 1 of the invention consists essentially of two bearing plates 2 and 3 which are arranged at a vertical spacing from one another and consist preferably of synthetic material. In the interest of simplicity in the following with reference to FIGS. 2 to 5 it will be a matter of the upper bearing plate 2 and of the lower bearing plate 3. Between the bearing plates there is arranged a one-piece resistance metal element 4.

It is essential to the invention that the resistance metal element 4 consists of a one-piece sheet metal stamped part strip which preferably forms segments arranged in succession stamped out in meander pattern. It is advantageous here if the successively arranged segments are likewise in meander form.

An especially advantageous spatial form of the resistance metal element 4 for the purposes of the invention is yielded from a plate 5, which is depicted in FIG. 1 in plan view. The plate consists of a one-piece sheet metal strip, for example of a width of 2 mm and a thickness of 0.3 mm. The spatial form of the plate is optimized inter alia with respect to the stamped-out sheet metal waste.

The spatial form of the plate 5 is formed in mirror symmetry to the longitudinal axis 10 and presents at least one contact segment 6 and a loop segment 7. The segments 6 and 7 are with the exception of an arch 7*a* constructed in mirror symmetry to a transverse axis 12. Between the segments 6 and 7 there can be present in alternation still further extension segments 11 and 11*a*, in which arrangement the segments 11*a* resemble in spatial form the segment 6 and the segments 11, with the exception of the arch 7*a* resemble the segment 7. In FIG. 1 there is shown in the drawing only one transverse axis 12, in order not to disturb the perspicuity. Nevertheless, the segments 11, 11*a* and 6 and 7, respectively, lie in each case in mirror symmetry to a transverse axis 12.

Since the segments 6, 7 11 and 11*a*, as described, are symmetrically formed, it suffices merely to characterize the segments 6 and 7.

The contact segment 6 or an extension segment 11*a* consists of two flow paths 6*a* and 6*b* stamped out in meander pattern, which are arranged spaced beside the axis 10 in each case, the paths 6*a* and 6*b* having the same spatial form in mirror symmetry to the axis 10. Each path 6*a*, 6*b* has at its disposal a strip 8 extending beside the axis 10 and parallel thereto in the direction toward the loop segment 7, which strip issues into an arch 8*a* directed away from the axis 10, upon which there follows a strip 8*b* leading back running parallel to the strip 8, which strip 8*b* on its part issues into a second arch 8*c* directed away from the axis 10 to the loop segment 7 or to an extension segment 11. The arches 8*a* and 8*c* are preferably constucted as 180° arcs (semicircular arcs), so that as viewed in plan there is yielded an ideal stmaped-out meander form. It lies within the scope of the invention to connect further flow paths stamped out in meander pattern in one piece to the side. It lies, furthermore, in the scope of the invention to choose flater arches 8*a* and/or 8*c*, so that the strips 8 and 8*b* and/or 8*b* and 8*c* diverge.

The loop 6*a* has, as already mentioned, the same spatial form as the loop 6*b*, for which reason the same reference symbols have been used.

The loop segment 7 or an extension segment 11 consists likewise of two flow paths 13*f* and 13*g* stamped out in meander pattern, which are arranged in each case spaced beside the axis 10, in which arrangement the paths 13*f* and 13*g* have the same spatial form in mirror symmetry to the axis 10. Each path 13*f*, 13*g* presents a strip 13*e* which lies coaxially to the strip 8*d*, i.e., the strip 8*d* goes over in one piece in the zone of an axis 12 into the strip 13*e*. At the end of the strip 13*e* there is present an arch 13*a* directed to the longitudinal axis 10, which arch 13*a* issues into a strip 13*b* running parallel to the strip 13*e*. The strip 13*b* goes over at the end lying opposite the arch 13*a* into an arch 13*c* directed to the longitudinal axis 10, upon which there follows a strip 13*d*, straight and running parallel to the strips 13*e* and 13*b*.

With an arch 7*a* which begins at the end lying opposite the arch 13*c* of the strip 13*d* the path 13*g* goes over into the path 13*f*, so that there is present a one-piece electric conductor stamped out in meander pattern of sheet metal stamped out strip, which is composed of the successively arrayed paths 6*b*, 13*g*, 13*f* and 6*a*, which with the arch 7*a* are connected with one another. When a current source is laid on the contact strip 8, the sheet metal strip can be heated up as a resistance element.

The arches 13*a* and 13*c* of the paths 13*g* and 13*f* are, like the arches 8*a* and 8*c* of the paths 6*a* and 6*b*, represented as 180° arcs, so that as viewed in plan there is likewise yielded an ideal stamped-out meander form. Also in this case it lies within the scope of the invention to connect further, in particular like-formed current paths stamped out in meander pattern in one piece. It lies further within the scope of the invention to choose flatter arches 13*a* and/or 13*c*, so that the strips 13*d* and 13*b*, as well as 13*b* and 13*e* diverge.

Preferably the contact strip 8 of the path 6*b* is constructed shorter than the contact strip of the path 6*a*. In FIG. 1 there is recognizable an expedient form, in which the contact strip of path 6*a* designated with the reference number 9 is longer and bent in plan in Z-arc form into the plane of the contact strip 8 of the path 6*b* in such a way that the end of the contact strip 9 comes to lie coaxially to the contact strip 8 or the path 6*b*.

The extension segments 11, 11*a* correspond, as already mentioned, in spatial form to the segments 6 or 7. In FIG. 1, correspondingly, there are entered the same reference symbols.

It is essential that according to the invention the segments are bent over in each case about a transverse axis 12 or in the transverse axis zone, in such a way that a downward-leading arch 14 is followed by an upward-leading arch 15, so that, as viewed in inflow direction (FIG. 2) there is yielded a resistance element 4 bent in meander pattern.

The arches 14 and 15 do not have to be executed round, as depicted, but can also be made angular and present a straight crosspiece 16. This form is suitable for the fastening of the resistance metal element 4 in the bearing plates 2 and 3. It is important that through the arches 14 and 15 there is created a sufficient spacing or interspace 17 between adjacent segments 6 and 7, respectively 11 and 11*a* or 6 and 11 and 11*a* and 7. The interspace 17 permits in an advantageous manner the strips 8*b*, 8*d* and 8 to spread toward the arch zones 8*c* and 8*a*, and the strips 13*e*, 13*d* and 13*b*, respectively, to spread oppositely toward the arch zones 13*a* and 13*c*, which is to be seen from FIG. 2, so that between the strips 8*d* and 8*b* as well as 8*b* and 8, respectively 13*e* and 13*d*, as well as 13*b* and 13*d* a gap 18 is formed. This spreading leads to the result that very many strips can be flowed upon directly by the fluid stream, the adjacent strips being arranged diagonally offset laterally in succession in flow direction. Thus, an optimal heat absorption by the fluid is brought about.

The resistance metal element 4, stamped out in meander pattern and bent perpendicularly in meander pattern to the stamped-out meander form sticks with pins 25 in the bearing plates 2 and 3, in which arrangement the bearing plate 2 and 3 are kept spaced by a crosspiece 19, 20. The crosspieces 19, 20 are prefered molded in one piece to the bearing plate 2, grip throught in each case with the rest arms 31, spaced by a U-shaped recess 30, in a corresponding opening 21 in the bearing plate 3 and rest with their rest lugs 22 behind an edge of the respective opening 21, the depth of the recess 30 being such that the bottom of the U-shaped recess 30 is seated on the upper inner surface of the bottom wall of the bearing plate 3, from which there results the maintenance of spacing. The crosspiece 20 presents recesses 23, 24 arranged perpendicular over one another, which are gripped through by the contact ends 8 and 9 bent outward, i.e. toward the crosspiece 20, so that there are created easily reachable connections for a current source.

For the solid seating in the bearing plates 2 and 3 according to a special form of execution of the invention bearing pins 25 in the zone of the arches 14 and 15, preferably in cross-piece 16, bound in each case to a side edge, are bent upward and downward, respectively at a right angle, grip through a slit 26 in the plate 2, 3 in closed linkage, preferably seating, and are bent over in the free end zone about in the manner of a riveting, so that they cannot directly slide out of the slit 26.

Preferably the bearing pins 25 are formed in such a way that they are seated unshiftably in the slit 26. For this purpose it is provided that the bearing pins each present on the two longitudinal edges in each case a step 32, the steps 32 are seated on the inner surfaces of the bottom walls of the bearing plate 2 and 3, respectively, since the slit 26 is executed narrower than the width of a bearing pin 25 in the zone of the steps 32, so that only the region of the pin 25 projected beyond the steps 32 grips through the slit 26. The type of fastening should expediently provide a spacing between the arches 14 and 15 as well as 13*a*, 13*c*, respectively 8*a*, 8*c*, from the bottom wall of an adjacent bearing plate 2, 3, so that the segments 6, 7 and 11, 11*a*, respectively, can expand unimpeded to the bottoms wall of the bearing plates 2, 3 in heat expansions of the segments. The fastening pins 25 are present in the bending zones 14, 15 in which the length changes on temperature fluctuation are virtually negligible. The temperaturecaused length changes are active rather in the arch zones 13*a*, 13*c* and 8*a*, 8*c*, respectively, as the segments in these zones can approach the bearing plates. In order to ensure that there is a good fixing of position of the segments in the bearing plates, according to a further form of execution of the invention it is provided that in the arch regions mentioned there are attached slide pins 27 projecting upward and downward, respectively, aligned in the material plane of the paths, which grip through closed-linkage corresponding slits 28 in the bottom wall of plates 2, 3 and in the case of heat expansions or shrinkages of the segments can slide up and down in these slits 28.

For the protection of the outside surfaces of the bottom walls of the bearing plates 2, 3 it is expediently provided that the bearing plates 2, 3 have outward-pointing frame-type crosspieces 29.

The new resistance heating element assures in the smallest space with respect to the proposal described a substantially greater surface, so that there can also be brought about a better giving-off of heat. Hitherto it has not been possible to form a resistance element from strip-form sheet metal stamped parts, although models of round wire were present. The creation of the special spatial form described makes it possible to form a resistance heating element that makes available a meander form both in flow direction and also perpendicularly thereto.

Instead of the arches 13*a*, 13*c* and 8*a*, 8*c*, respectively, there can also be stamped out simple straight-running crosspieces or crosspieces stamped otherwise than as arcuate ones, that lie between the strips 13*e*, 13*d* and 13*b*, respectively, 8*d*, 8*b* and 8.

It is especially advantageous for the production of the plate to provide a connecting crosspiece between the arches 13*a* and 8*a*, respectively 8*a* and 13*c*, which is generated for the formation of a slide pin each by an S-form or Z-form severing cut without loss of material.

What is claimed is:

1. A resistance heating element comprising:

an integral one-piece sheet metal stamped part strip disposed between bearing elements fabricated from electrically insulating material;

said one-piece strip having a longitudinal meander pattern;

said one-piece strip being bent to provide at least first and second segments connected by arch means to position said first segment in front of said second segment;

each of said first and second segments having a transverse meander pattern;

said first segment having first and second electrical terminal means to complete a conductive path from said first terminal means through said first segment and said arch means to said second segment, and then back from said second segment through said arch means and said first segment to said second terminal means;

said longitudinal and transverse meander patterns providing said conductive path;

bearing means for securing said first and second segments to the bearing elements, said bearing means being bearing pins constructed as part of said one-piece strip; and slide means for freely projecting through openings in the bearing elements to permit expansion and shrinkage of said first and second segments while maintaining said first and second segments in position between the bearing elements, said slide means being slide pins constructed as part of said one-piece strip;

whereby the one-piece construction of said strip avoids damage thereof during use when subjected to forced movements, jarrings and vibrations.

2. A resistance heating element according to claim 1, wherein said one-piece strip is bent to provide additional segments connected by additional arch means to arrange said first, second and additional segments in succession one in front of another, said additional segments also having a transverse meander pattern.

3. A resistance heating element according to claim 1, wherein said one-piece strip defines a plate having a mirror symmetry to a longitudinal axis of said plate.

4. A resistance heating element according to claim 3, wherein said first segment defines a contact segment and said second segment defines a loop segment, said loop segment having an arch portion, said contact segment and said loop segment with the exception of said arch portion being in mirror symmetry to a transverse axis of said plate.

5. A resistance heating element according to claim 4, wherein said plate includes at least additional third and fourth segments arranged between said contact and loop segments, said third segment resembling said contact segment with the exception of said terminal means, and said fourth segment resembling said loop segment with the exception of said arch portion.

6. A resistance heating element according to claim 5, wherein adjacent ones of said segments are in mirror symmetry to a respective transverse axis of plate with the exception of said terminal means and said arch portion.

7. A resistance heating element according to claim 3, wherein said first segment has two flow path members each having a meander pattern, said two flow path members being arranged on opposite sides of said longitudinal axis in mirror symmetry.

8. A resistance heating element according to claim 7, wherein each of said two flow path members has one of said terminal means defining an inner strip portion longitudinally extending adjacent to and parallel to said longitudinal axis in a direction of said second segment, a first arch portion having an end connected to said inner strip portion and directed away from said longitudinal axis, an intermediate strip portion connected to an opposite end of said first arch portion and longitudinally extending parallel to said inner strip portion in a direction away from said second segment, a second arch portion having an end connected to said intermediate strip portion and also directed away from said longitudinal axis, and an outer strip portion connected to an opposite end of said second arch portion and longitudinally extending parallel to said intermediate portion in said direction of said second segment for connection to said second segment.

9. A resistance heating element according to claim 8, wherein said first and second arch portions have 180 degree arcs.

10. A resistance heating element according to claim 8, wherein said inner strip portions defining said terminal means are of different lengths so that one inner strip portion is longer than the other inner strip portion.

11. A resistance heating element according to claim 10, wherein said one longer inner strip portion is arcuately bent in the same first plane as said first segment with an end of said one longer inner strip portion being in the same second plane as said other inner strip portion, said second plane being perpendicular to said first plane.

12. A resistance heating element according to claim 8, wherein said first and second arch portions are disposed in a first plane, said inner and outer strip portions being bent in one direction into a second plane, said intermediate portion being bent in an opposite direction into a third plane, said first and second and third planes being parallel to each other to provide a lateral gap between said inner and outer strip portions and said intermediate portion.

13. A resistance heating element according to claim 3, wherein said second segment has two flow path members each having a meander pattern, said two flow path members being arranged on opposite sides of said longitudinal axis in mirror symmetry.

14. A resistance heating element according to claim 13, wherein said first segment also has two flow path members each having a meander pattern and arranged on opposite sides of said longitudinal axis in mirror symmetry, all said flow path members being successively connected together with said second segment having an arch portion to connect its two flow path members together to complete said conductive path.

15. A resistance heating element according to claim 13, wherein each of said two flow path members has an inner strip portion longitudinally extending adjacent to and parallel to said longitudinl axis in a direction of said first segment, a first arch portion having an end connected to said inner strip portion and directed away from said longitudinal axis, an intermediate strip portion connected to an opposite end of said first arch portion and longitudinlly extending parallel to said inner strip portion in a direction away from said first segment, a second arch portion having an end connected to said intermediate strip portion and also directed away from said longitudinal axis, and an outer strip portion connected to an opposite end of said second arch portion and longitudinally extending parallel to said intermediate portion in said direction of said first segment for connection to said first segment.

16. A resistance heating element according to claim 15, wherein a third arch portion connects said inner strip portions of said two flow path members together to complete said conductive path.

17. A resistance heating element according to claim 15, wherein said first and second arch portions are disposed in a first plane, said inner and outer strip portions being bent in one direction into a second plane, said intermediate portion being bent in an opposite direction into a third plane, said first and second and third planes being parallel to each other to provide a lateral gap between said inner and outer strip portions and said intermediate portion.

18. A resistance heating element according to claim 2, wherein said arch and additional arch means include arches having bight portions adjacent to associated ones of the bearing elements to provide a serpentine arrangement.

19. A resistance heating element according to claim 18, wherein each of said arches has a straight horizontal crosspiece.

20. A resistance heating element according to claim 19, wherein each said crosspiece has a selected predetermined length to provide an interspace between adjacent ones of said segments.

21. A resistance heating element according to claim 1, wherein the bearing elements are constructed as upper and lower bearing plates being vertically spaced from each other, said bearing pins being secured in associated ones of said bearing plates.

22. A resistance heating element according to claim 21, wherein said upper bearing plate includes spaced apart downwardly extending crosspieces, a free end of each crosspiece having an upwardly directed rest lug, said lower bearing plate having openings to receive said crosspiece free ends therethrough with said rest lugs engaging an under surface of said lower bearing plate.

23. A resistance heating element according to claim 22, wherein each of said crosspiece free ends has a recess to provide a pair of rest arms with one of said rest lugs at an end of each rest arm, each said recess having a selected predetermined depth to permit a bottom of each said recess to be seated on an upper surface of said lower bearing plate.

24. A resistance heating element according to claim 22, wherein one of said crosspieces includes recesses disposed vertically one over the other to receive said first and second terminal means, respectively.

25. A resistance heating element according to claim 21, wherein said bearing pins are connected to said arch means, said bearing pins extending through slits in said bearing plates with ends of said bearing pins being bent over for securement thereof.

26. A resistance heating element according to claim 25, wherein each of said bearing pins has a step on each opposing longitudinal edge for seating on an inner surface of said bearing plates.

27. A resistance heating element according to claim 21, wherein said arch means are spaced from adjacent ones of said bearing plates.

28. A resistance heating element according to claim 21, wherein said slide pins are connected to said segments adjacent said arch means and extend toward asociated ones of said bearing plates for sliding receiption in said openings, said openings being slits in said bearing plates.

29. A resistance heating element according to claim 21, wherein each of said bearing plates includes a bottom wall provided with outward-facing frame-type crosspieces.

* * * * *